US008222982B2

(12) United States Patent
Sullivan et al.

(10) Patent No.: US 8,222,982 B2
(45) Date of Patent: Jul. 17, 2012

(54) OVERLOAD RELAY TRIP MECHANISM

(75) Inventors: Jackie C. Sullivan, Burlington, NC (US); Richard Karl Weiler, Raleigh, NC (US); Stanley H. Edwards, Jr., Raleigh, NC (US)

(73) Assignee: Schneider Electric USA, Inc., Palatine, IL (US)

( * ) Notice: Subject to any disclaimer, the term of this patent is extended or adjusted under 35 U.S.C. 154(b) by 330 days.

(21) Appl. No.: 12/648,207

(22) Filed: Dec. 28, 2009

(65) Prior Publication Data

US 2011/0156847 A1 Jun. 30, 2011

(51) Int. Cl.
*H01H 9/20* (2006.01)

(52) U.S. Cl. ..... 335/166; 335/26

(58) Field of Classification Search ..... 335/26, 335/166, 18

See application file for complete search history.

(56) References Cited

U.S. PATENT DOCUMENTS

| | | | | | |
|---|---|---|---|---|---|
| 4,802,052 | A * | 1/1989 | Brant et al. | ..... | 361/42 |
| 5,332,986 | A | 7/1994 | Wieloch | ..... | 335/78 |
| 5,657,194 | A | 8/1997 | Waltz | ..... | 361/75 |
| 5,910,759 | A | 6/1999 | Passow | ..... | 335/78 |
| 5,959,518 | A | 9/1999 | Passow | ..... | 335/78 |
| 5,994,987 | A | 11/1999 | Passow | ..... | 335/78 |
| 6,020,801 | A | 2/2000 | Passow | ..... | 335/78 |
| 6,025,766 | A | 2/2000 | Passow | ..... | 335/78 |
| 6,046,661 | A | 4/2000 | Reger et al. | ..... | 335/185 |
| 6,661,319 | B2 | 12/2003 | Schmelz | ..... | 335/78 |
| 6,788,176 | B2 | 9/2004 | Schmelz | ..... | 335/80 |
| 6,937,451 | B2 * | 8/2005 | Ulrich et al. | ..... | 361/42 |
| 6,949,997 | B2 | 9/2005 | Bergh et al. | ..... | 335/78 |
| 7,049,911 | B2 * | 5/2006 | Germain et al. | ..... | 335/18 |
| 7,164,563 | B2 * | 1/2007 | Chan et al. | ..... | 361/42 |
| 7,177,126 | B2 * | 2/2007 | Ulrich et al. | ..... | 361/42 |
| 7,187,526 | B2 * | 3/2007 | DiSalvo | ..... | 361/42 |
| 7,378,927 | B2 * | 5/2008 | DiSalvo et al. | ..... | 335/18 |
| 7,414,499 | B2 * | 8/2008 | Germain | ..... | 335/18 |
| 7,545,244 | B2 * | 6/2009 | DiSalvo et al. | ..... | 335/18 |
| 7,558,034 | B2 * | 7/2009 | Bonasia et al. | ..... | 361/42 |

* cited by examiner

*Primary Examiner* — Elvin G Enad
*Assistant Examiner* — Lisa Homza
(74) *Attorney, Agent, or Firm* — Nixon Peabody LLP

(57) ABSTRACT

An overload relay trip mechanism includes a housing, a reset button, a leaf spring, a test button, a coil spring, and an actuator. The reset button can be actuated from a normal position to a reset position to cause the leaf spring to transition from a first position to a second position, which causes a reset actuator-engaging element to move the actuator from a tripped position to a closed position. The test button can be actuated from a normal position to a test-stop position to cause a first test actuator-engaging element to move a moveable contact from an electrically connected position to an electrically disconnected position. The test button can further be moved from the test-stop position to the test-trip position to cause a second test actuator-engaging element to move the actuator from the closed position to the tripped position.

24 Claims, 9 Drawing Sheets

OVERLOAD RELAY TRIP MECHANISM

FIELD OF THE INVENTION

The present invention relates generally to electrical relays and, more particularly, to a trip mechanism for an overload relay.

BACKGROUND OF THE INVENTION

Overload relays are electrical switches used to protect electrical equipment, such as, for example, motors, from current overloads. Once an overload relay trips, preventing the flow of current to the electrical equipment, it must be reset. Overload relays employ a reset button that allows an operator to reset manually the overload relay, which closes internal electrical contacts to restore electrical current flow to the equipment. Typically, reset buttons require several intermediary parts, beyond the reset button itself, to accomplish the resetting function. These intermediary parts provide a "trip free" overload relay that prevents the overload relay from being defeated in response to the reset button being held and/or jammed in the reset position. Overload relays also provide means for momentarily interrupting the flow of current to the equipment, known as a "test-stop" feature and separate means for manually tripping the overload relay for test purposes, known as a "test-trip" feature. Each of these separate means for providing the test-stop and test-trip features typically requires several parts.

Thus, a need exists for an improved apparatus. The present invention is directed to satisfying one or more of these needs and solving other problems.

SUMMARY OF THE INVENTION

According to some aspects of the present disclosure, an overload relay trip mechanism for selectively opening and closing a control circuit includes a housing, a reset button, a spring, and an actuator. The housing has an aperture. A part of the reset button is positioned through the aperture in the housing. The reset button includes a button portion and a shaft portion. The shaft portion has a first end coupled with the button portion and a second opposing end that has an actuator-engaging element. The reset button has a normal position and a reset position. The spring has a first end and a second opposing end. The first end of the spring is supported by the housing and the second end of the spring is flexibly coupled with the shaft portion or the button portion of the reset button. The spring has a first position that corresponds with the normal position of the reset button and a second position that corresponds with the reset position of the reset button. The actuator is coupled with a moveable contact. The actuator has a closed position in which the moveable contact is electrically connectable with a corresponding fixed contact and an open position in which the moveable contact is electrically disconnected from the corresponding fixed contact. The reset button can be moved from the normal position to the reset position to cause the spring to transition from the first position to the second position, which causes the actuator-engaging element to move the actuator from the open position to the closed position, thereby resetting the control circuit.

According to some aspects of the present disclosure, an overload relay trip mechanism for selectively opening and closing a control circuit includes a housing, a test button, a spring, and an actuator. The housing has an aperture. A part of the test button is positioned through the aperture in the housing. The test button includes a button portion and a shaft portion. The shaft portion has a first end coupled with the button portion and a second opposing end that has a first actuator-engaging element and a second actuator-engaging element. The test button has a normal position, a test-stop position, and a test-trip position. The spring is positioned between the button portion of the test button and the housing such that movement of the test button in a direction of travel compresses the spring between the button portion and the housing. The spring has a first position that corresponds with the normal position of the test button, a second position that corresponds with the test-stop position of the test button, and a third position that corresponds with the test-trip position of the test button. The actuator is coupled with a moveable contact. The actuator has a closed position in which the moveable contact is electrically connectable with a corresponding fixed contact and a tripped position in which the moveable contact is electrically disconnected from the corresponding fixed contact. The test button can be moved from the normal position to the test-stop position to cause the first actuator-engaging element to move the moveable contact from an electrically connected position to an electrically disconnected position in the closed position of the actuator. The test button can further be moved from the test-stop position to the test-trip position to cause the second actuator-engaging element to move the actuator from the closed position to the tripped position.

According to other aspects of the present disclosure, an overload relay trip mechanism for selectively opening and closing a control circuit includes a housing, a rest button a negative-rate spring, a test button, a dual-rate spring, and an actuator. The housing has a first aperture and a second aperture. A part of the reset button is positioned through the first aperture and a part of the test button is positioned through the second aperture. The reset button has a reset actuator-engaging element, a normal position, and a reset position. The negative-rate spring is supported by the housing and coupled with the reset button. The negative-rate spring has a first position that corresponds with the normal position of the reset button and a second position that corresponds with the reset position of the reset button. The test button has a first test actuator-engaging element and a second test actuator-engaging element. The test button has a normal position, a test-stop position, and a test-trip position. The dual-rate spring is positioned between the housing and a portion of the test button. The dual-rate spring has a first position that corresponds with the normal position of the test button, a second position that corresponds with the test-stop position of the test button, and a third position that corresponds with the test-trip position of the test button. The actuator is coupled with a moveable contact. The actuator has a closed position in which the moveable contact is electrically connectable with a corresponding fixed contact and a tripped position in which the moveable contact is electrically disconnected from the corresponding fixed contact. The reset button can be moved from the normal position to the reset position to cause the negative-rate spring to transition from the first position to the second position, which causes the reset actuator-engaging element to move the actuator from the tripped position to the closed position. The test button can be moved from the normal position to the test-stop position to cause the second actuator-engaging element to move the moveable contact from an electrically connected position to an electrically disconnected position in the closed position of the actuator. The test button can further be moved actuated from the test-stop position to the test-trip position to cause the third actuator-engaging element to move the actuator from the closed position to the tripped position.

The foregoing and additional aspects and implementations of the present disclosure will be apparent to those of ordinary skill in the art in view of the detailed description of various implementations and/or aspects, which is made with reference to the drawings, a brief description of which is provided next.

BRIEF DESCRIPTION OF THE DRAWINGS

The foregoing and other advantages of the invention will become apparent upon reading the following detailed description and upon reference to the drawings.

DETAILED DESCRIPTION OF THE ILLUSTRATED EMBODIMENTS

Although the present disclosure will be described in connection with certain aspects and/or implementations, it will be understood that the present disclosure is not limited to those particular aspects and/or implementations. On the contrary, the present disclosure is intended to cover all alternatives, modifications, and equivalent arrangements as may be included within the spirit and scope of the invention as defined by the appended claims.

Figure 1:
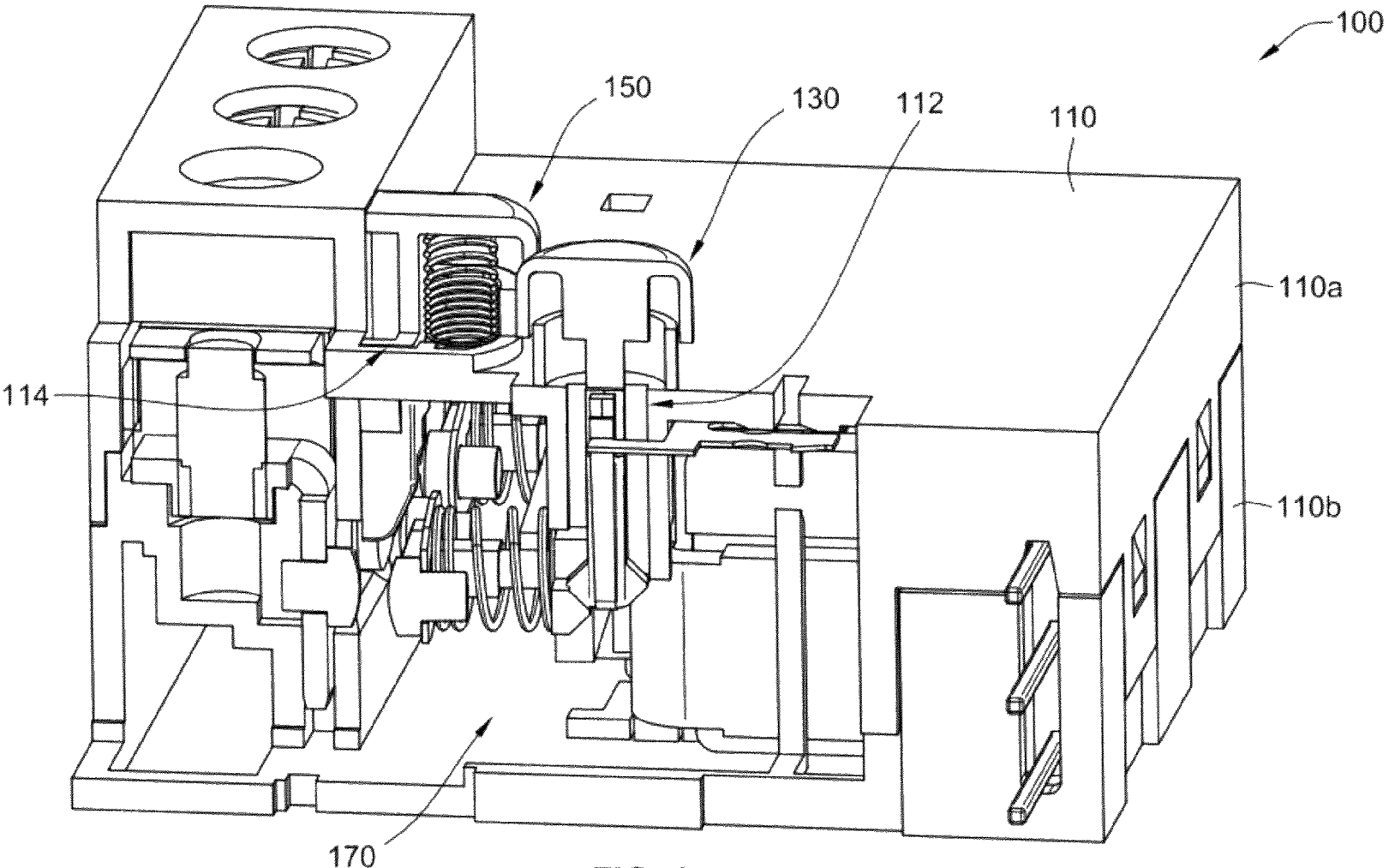
FIG. 1 is a partial perspective view of a overload relay trip mechanism having a housing partially removed according to some aspects of the present disclosure.

Referring to FIG. 1, a partial perspective view of a overload relay trip mechanism 100 is illustrated. The overload relay trip mechanism 100 is generally used to selectively open and close a control circuit (not shown). The control circuit can be conventionally used to control power to a variety of electrical components, such as, for example, a motor.

The overload relay trip mechanism 100 generally includes a housing 110, a reset button assembly 130, a test button assembly 150, and a contact assembly 170. A portion of the housing 110 is removed to illustrate the positions and physical relationships between the reset button assembly 130 and the housing 110; the test button assembly 150 and the housing 110; and the contact assembly 170 with the reset button assembly 130 and with the test button assembly 150. The housing 110 includes a top portion 110*a* and a corresponding bottom portion 110*b*. The top portion 110*a* can be configured to snap onto or otherwise couple to the bottom portion 110*b* to form the housing 110. The top portion 110*a* of the housing 110 includes a first aperture 112 and a second aperture 114. The first aperture 112 is positioned such that a part of the reset button assembly 130 is positioned therethrough. The second aperture 114 is positioned such that a part of the test button assembly 150 is positioned therethrough. The housing 110 can be made of any insulating material such as plastic, rubber, etc.

Figure 2A:
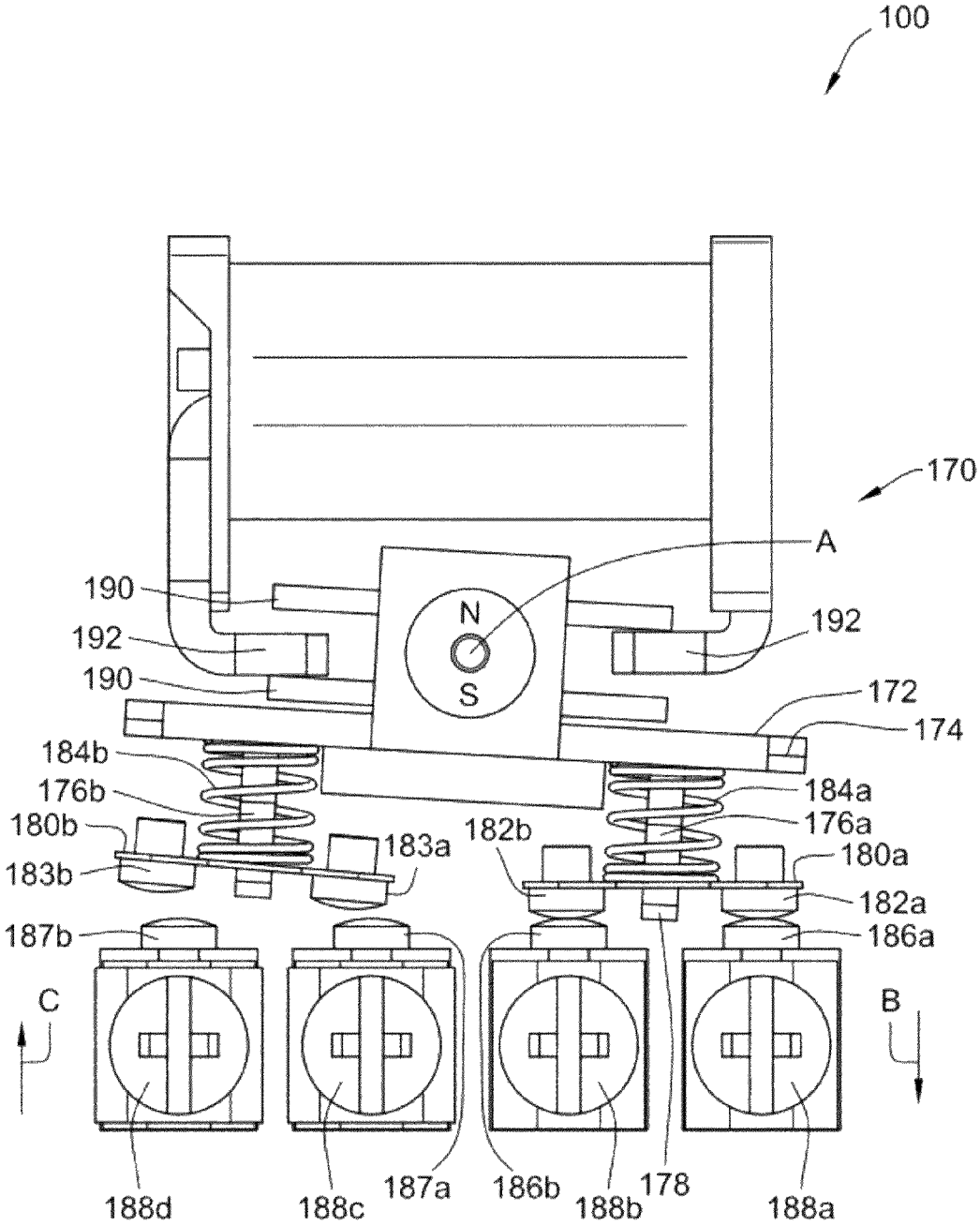
FIG. 2A is a partial top view of the overload relay trip mechanism of FIG. 1 in a closed position according to some aspects of the present disclosure.
Figure 2B:
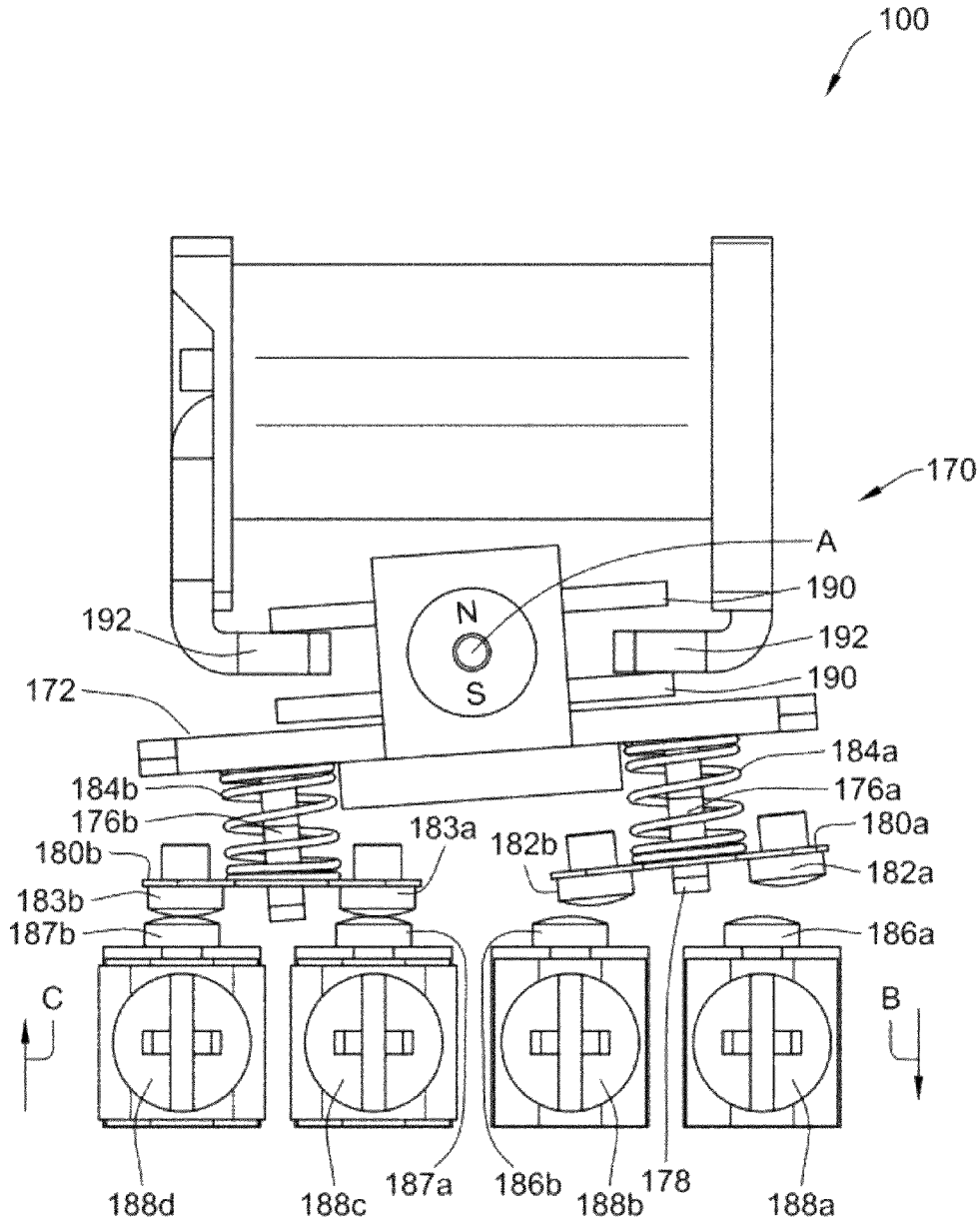
FIG. 2B is a partial top view of the overload relay trip mechanism of FIG. 1 in a tripped position according to some aspects of the present disclosure.

Referring to FIGS. 2A and 2B, partial top views of the overload relay trip mechanism 100 in two distinct positions are illustrated. FIG. 2A illustrates the overload relay trip mechanism 100 in a closed position. The closed position can also be referred to as a run position. FIG. 2B illustrates the overload relay trip mechanism 100 in a tripped position. The tripped position can also be referred to as an open position. The housing 110 and several peripheral components are removed to better illustrate the contact assembly 170. The contact assembly 170 generally includes an actuator 172, a pair of contact posts 176*a,b*, a pair of moveable contact blades 180*a,b*, a pair of moveable run contacts 182*a,b*, and a pair of moveable auxiliary contacts 183*a,b*.

The actuator 172 has a closed position, as shown in FIG. 2A, and a tripped position, as shown in FIG. 2B, which correspond with the closed and tripped positions of the overload relay trip mechanism 100. The actuator 172 is operable to rotate or pivot about fixed point A between the closed position (FIG. 2A) and the tripped position (FIG. 2B). In response to the actuator 172 being in the closed position (FIG. 2A), the moveable run contacts 182*a,b* are electrically connectable with corresponding fixed run contacts 186*a,b* and the moveable auxiliary contacts 183*a,b* are electrically disconnected from corresponding fixed auxiliary contacts 187*a,b*. By "electrically connectable," it is meant that movable contacts can be electrically connected to or disconnected from corresponding fixed contacts. In response to the actuator 172 being in the tripped position (FIG. 2B), the moveable run contacts 182*a,b* are electrically disconnected from the fixed run contacts 186*a,b* and the moveable auxiliary contacts 183*a,b* are electrically connectable with the corresponding fixed auxiliary contacts 187*a,b*. As described below, the moveable run contacts 182*a,b* are electrically connectable with corresponding fixed run contacts 186*a,b* because the test button assembly 150 can momentarily electrically disconnect the moveable run contacts 182*a,b* from the corresponding fixed run contacts 186*a,b* even in response to the actuator 172 being in the closed position (FIG. 2A). Such a momentary electrical disconnection feature is referred to herein as a test-stop feature of the test button assembly 150.

Each of the contact posts 176*a,b* is slidably engaged with a respective one of the moveable contact blades 180*a,b*. The first moveable contact blade 180*a* is generally biased in the direction of arrow B by a first contact spring 184*a*. The first moveable contact blade 180*a* can be forced in the direction the arrow C along the first contact post 176*a*, thereby compressing the first contact spring 184*a*. Similarly, the second moveable contact blade 180*b* is generally biased in the direction of arrow B by a second contact spring 184*b*. The second moveable contact blade 180*b* can be forced in the direction of arrow C along the second contact post 176*b*, thereby compressing the second contact spring 184*b*. As will be explained below in reference to FIGS. 4A-4C, the test button assembly 150 can move the first moveable contact blade 180*a* in the direction of arrow C.

The first moveable contact blade 180*a* is physically and electrically connected with the pair of moveable run contacts 182*a,b*. As such, in response to the moveable contact blade 182*a* being moved along the first contact post 176*a* in the direction of arrow C, the pair of moveable run contacts 182*a,b* is likewise moved in the direction of arrow C a corresponding distance. Similarly, the second moveable contact blade 180*b* is physically and electrically connected with the pair of moveable auxiliary contacts 183*a,b*. As such, in response to the moveable contact blade 182*b* being moved along the second contact post 176*b* in the direction of arrow C, the pair of moveable auxiliary contacts 183*a,b* is likewise moved in the direction of arrow C a corresponding distance.

The pair of moveable run contacts 182*a,b* can be positioned to electrically couple with corresponding individual contacts of a pair of fixed run contacts 186*a,b*. Each one of the pair of fixed run contacts 186*a,b* is electrically and physically coupled with a respective terminal 188*a,b*. The terminals 188*a,b* can accept and electrically connect respective electrical run wires (not shown) with respective ones of the fixed contacts 186*a,b*. The electrical run wires can be electrically connected with like terminals in a contractor. Typically, a contractor coupled with an overload relay trip mechanism, like the overload relay trip mechanism 100, is known as a starter for controlling power supplied to, for example, a three-phase electrical motor.

Similarly, the pair of moveable auxiliary contacts 183*a,b* can be positioned to electrically couple with corresponding individual contacts of a pair of fixed auxiliary contacts 187*a,b*. Each one of the pair of fixed auxiliary contacts 187*a,b* is electrically and physically coupled with a respective terminal 188*c,d*. The terminals 188*c,d* can accept and electrically connect respective electrical auxiliary wires (not shown) with respective ones of the fixed contacts 187*a,b*. The electrical auxiliary wires can be electrically connected with like terminals in an auxiliary electrical component, such as, for example, a red warning light or a speaker. Typically, an auxiliary electrical component can be electrically powered by the overload relay trip mechanism 100 in the tripped position. Such an auxiliary electrical component can be used to indicate to an operator of the overload relay trip mechanism 100 that a trip has occurred—the actuator is in the tripped position.

The actuator 172 is physically connected with an armature 190 such that rotation or pivoting of the actuator 172 about point A results in a corresponding rotation of the armature 190 about point A and vice versa. The armature 190 is configured to magnetically interact with a yoke 192 as is commonly known in the art to electronically trip and/or reset the overload relay trip mechanism 100. That is, the armature 190 and the yoke 192 are configured to cause the actuator 172 to move between the closed position (FIG. 2A) and the tripped position (FIG. 2B).

The actuator 172 includes a reset engagement surface 174. The reset engagement surface 174 can correspond to an angled portion of a wedge (see FIGS. 3A-3C). As will be explained below in reference to FIGS. 3A-3C, the reset engagement surface 174 can slidably interact with the reset button assembly 130 to move the actuator 172 from the tripped position (FIG. 2B) to the closed position (FIG. 2A), thereby resetting the control circuit.

The first contact post 176*a* of the actuator 172 includes a test engagement surface 178. The test engagement surface 178 can correspond to an angled portion of a wedge (see FIGS. 4A-4C). As will be explained below in reference to FIGS. 4A-4C, the test engagement surface 178 can slidably interact with the test button assembly 150 to move the actuator 172 from the closed position (FIG. 2A) to the tripped position (FIG. 2B), thereby breaking the control circuit.

Figure 3A:
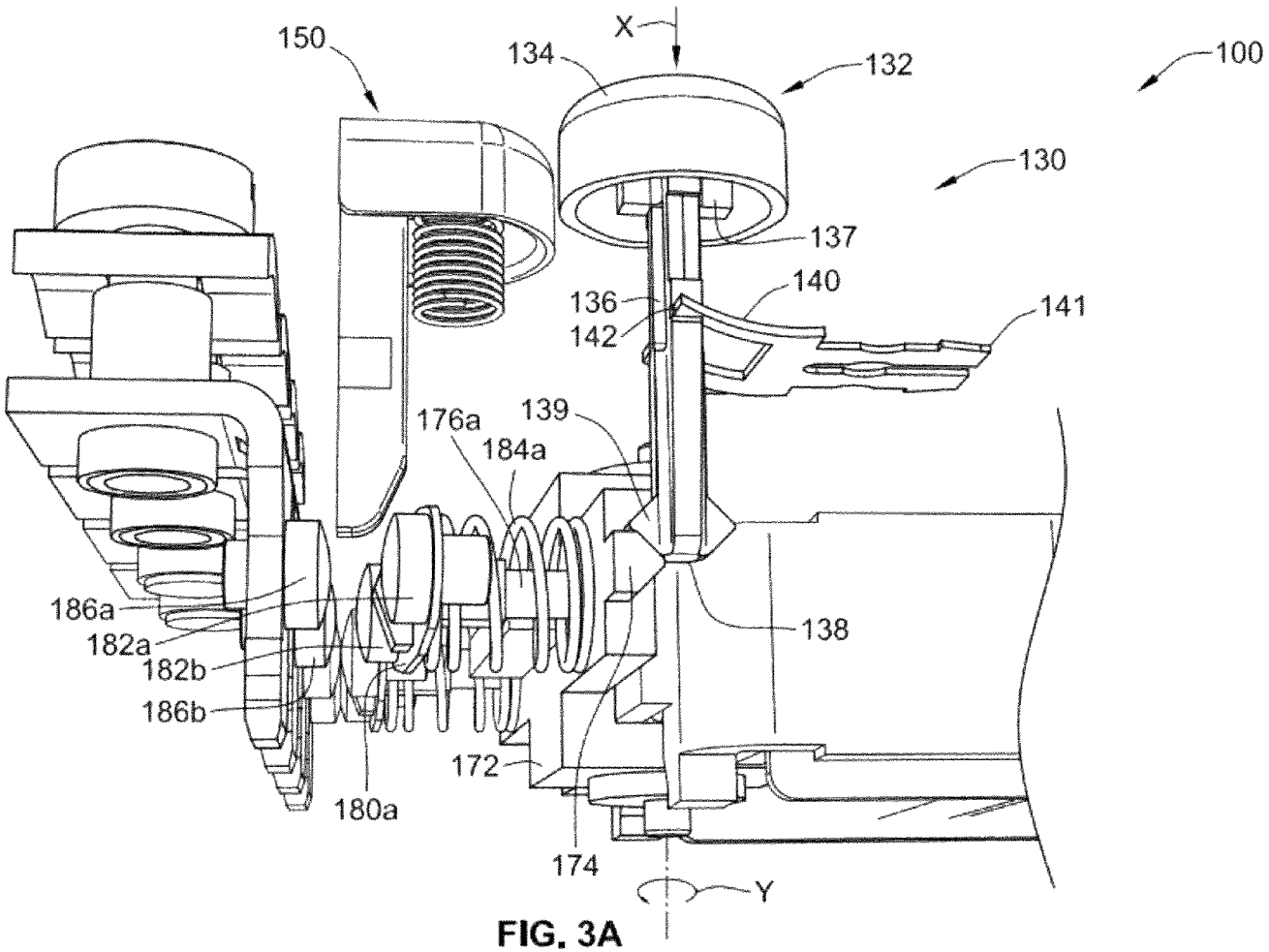
FIG. 3A is a partial perspective front view of the overload relay trip mechanism in the tripped position of FIG. 1 with the housing removed and a reset button in a normal position according to some aspects of the present disclosure.
Figure 3B:
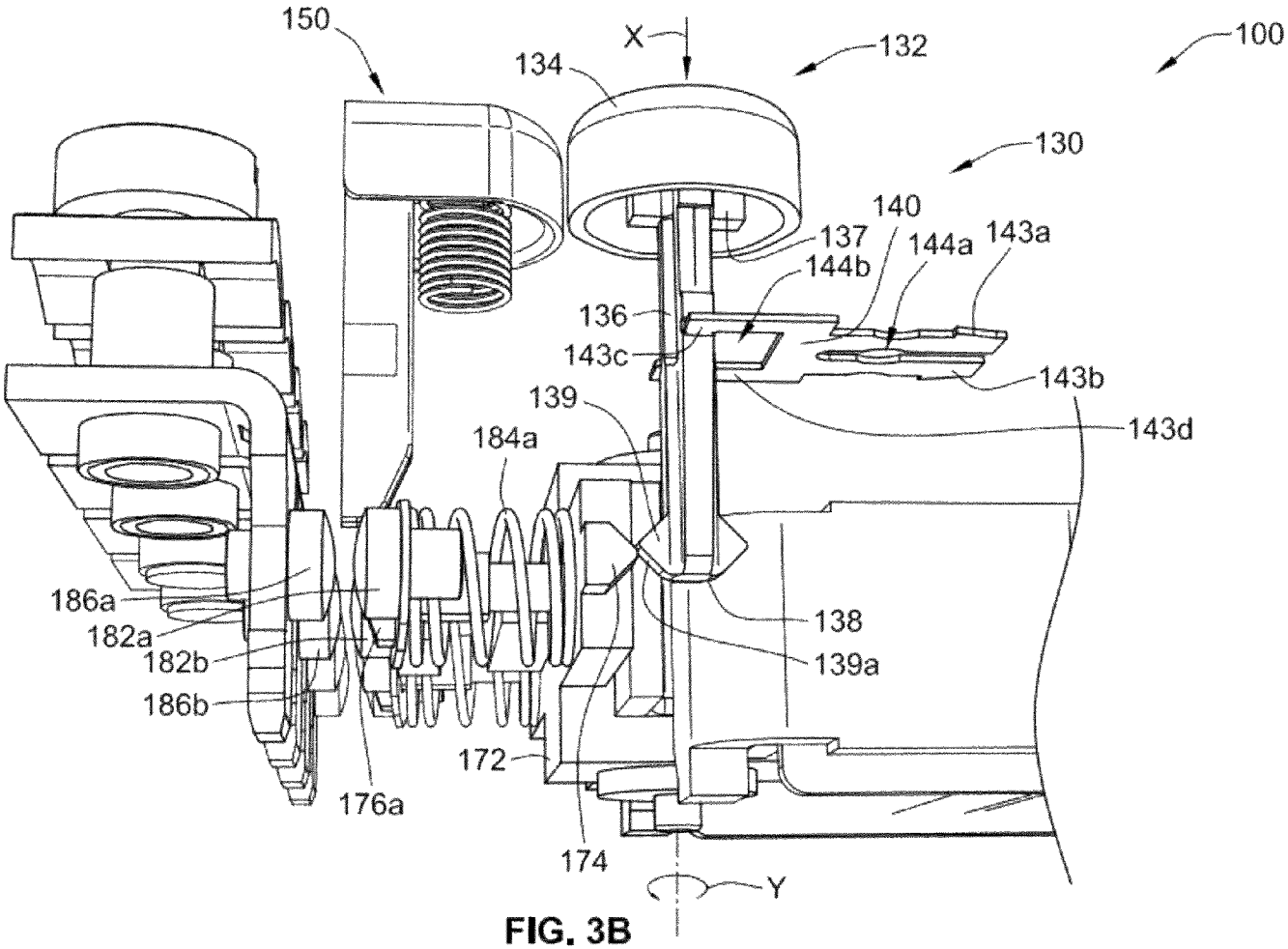
FIG. 3B is a partial perspective front view of the overload relay trip mechanism of FIG. 3A with the reset button in an intermediary position according to some aspects of the present disclosure.
Figure 3C:
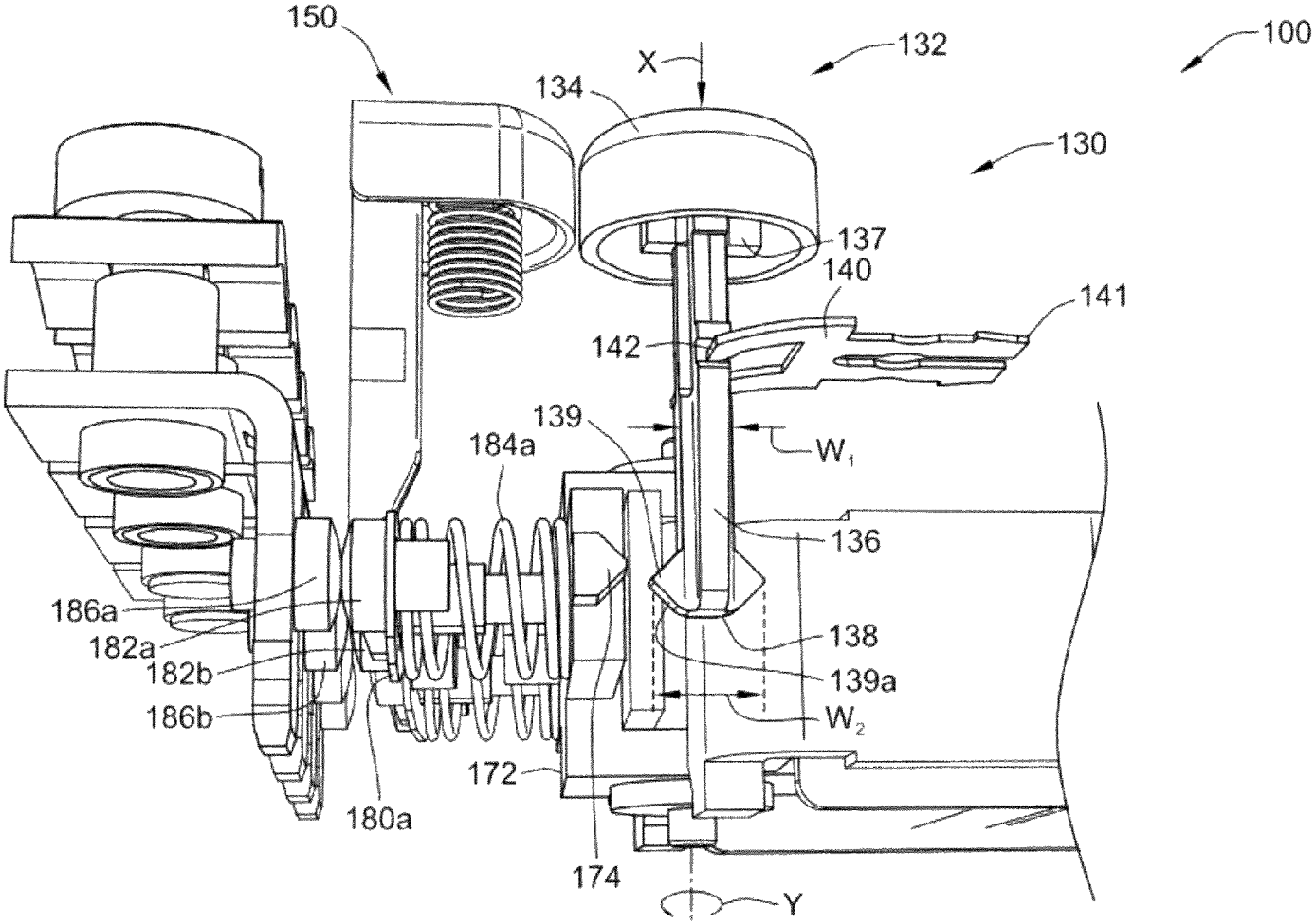
FIG. 3C is a partial perspective front view of the overload relay trip mechanism of FIG. 3A with the reset button in a reset position according to some aspects of the present disclosure.

Referring generally to FIGS. 3A-3C, a method or mode of resetting the overload relay trip mechanism 100 from the tripped position (FIG. 3A) to the closed position (FIG. 3C) using the reset button assembly 130 is described. FIGS. 3A-3C are partial perspective front views of the overload relay trip mechanism 100 with the housing 110 removed to better illustrate the reset button assembly 130. FIG. 3A illustrates the overload relay trip mechanism 100 in the tripped position. FIG. 3C illustrates the overload relay trip mechanism 100 in the closed position. FIG. 3B illustrates the overload relay trip mechanism 100 in an intermediary position between the tripped position (FIG. 3A) and the closed position (FIG. 3C).

The reset button assembly 130 includes a reset button 132 and a spring 140. The reset button 132 has a button portion 134 and a shaft portion 136. The shaft portion 136 has a first end 137 and a second opposing end 138. The first end 137 of the shaft portion 136 is physically coupled with the button portion 134. The second opposing end 138 of the shaft portion 136 includes an actuator-engaging element 139, also referred to herein as a reset actuator engagement element 139. The reset button 132 generally has a normal position (FIG. 3A) and a reset position (FIG. 3C). The normal position can also be referred to as a resting position of the reset button 132. The reset button 132 can be actuated in the direction of arrow X by, for example, an operator's finger, from the normal position (FIG. 3A) to the reset position (FIG. 3C).

The spring 140 illustrated in the Figures and described herein is a negative-rate spring 140, although the spring 140 can alternatively be a leaf spring, a bistable spring, a Belleville spring, a coil spring, a conical spring, etc. The spring 140 has a first end 141 and a second opposing end 142. The first end 141 of the spring 140 is fixedly coupled to and/or supported by the top portion 110*a* of the housing 110. The second opposing end 142 of the spring 140 is coupled with the shaft portion 136 or the button portion 134 of the reset button 132. The spring 140 has a first position, shown in FIG. 3A, that corresponds with the normal position of the reset button 132 and a second position, shown in FIG. 3C, that corresponds with the reset position of the reset button 132. The spring 140 is generally biased to be in the first position (FIG. 3A) such that in response to the spring 140 being transitioned or deformed into the second position (FIG. 3C) or any position therebetween (e.g., intermediary position of FIG. 3B), the spring 140 automatically returns to the first position (FIG. 3A). The spring 140 is generally concave in the first position (FIG. 3A) relative to the top portion 110*a* of the housing 110 and generally convex in the second position (FIG. 3C) relative to the top portion 110*a* of the housing 110.

The spring 140 is of a generally "H" shape having four legs 143*a,b,c,d* and two slots 144*a,b*. The first and the second legs 143*a,b* define the first slot 144*a* that extends from first end 141 towards the second end 142 of the spring 140. Similarly, the third and the fourth legs 143*c,d* define the second slot 144*b* that extends from second end 142 towards the first end 141 of the spring 140. The first slot 144*a* has a narrower width than the second slot 144*b*, although different slot widths can be implemented, such as, for example, the first and the second slots 144*a,b* can have the same width or the second slot 144*b* can be narrower than the first slot 144*a*.

The spring 140 is positioned within the housing 110 such that the housing 110 automatically and constantly squeezes the first end 141 of the spring 140 and/or squeezes the first and the second legs 143*a,b* together to cause the spring 140 to adopt the first position (FIG. 3A). That is, the positioning of the spring 140 within the housing 110 causes the spring 140 to adopt the first position as shown in FIG. 3A. As described below, the reset button 132 can be actuated in the direction of arrow X, from the normal position to the reset position, to oppose the biasing force of the spring 140 to transition the spring 140 from the first position (FIG. 3A), through the intermediary position (FIG. 3B), to the second position (FIG. 3C).

The shaft portion 136 of the reset button 132 is coupled between the third and the fourth legs 143*c,d* of the spring 140. The legs 143*c,d* can be removably coupled to the shaft portion 136 of the reset button 132 via slots (not shown). The spring 140 is coupled to the shaft portion 136 of the reset button 132 such that movement or actuation of the reset button 132 in the direction of arrow X can cause the spring 140 to snap suddenly or otherwise switch or transition from the first position (FIG. 3A), through the intermediary position (FIG. 3B), to the second position (FIG. 3C). That is, generally speaking, the second end 142 of the spring 140 moves in response to the reset button 132 moving in the direction of arrow X.

In response to a force being exerted on the reset button 132 in the direction of arrow X, the spring 140 adopts the second position (FIG. 3C). In response to the force being removed from the reset button 132, the spring 140 can automatically adopt the first position (FIG. 3A).

The reset actuator-engagement element 139 can be physically integral with or otherwise coupled to the second opposing end 138 of the shaft portion 136 of the reset button 132. The reset button 132 can be a single part that can be formed from, for example, an injection plastic-molding process. The reset actuator-engagement element 139 includes a surface 139*a* that can be angled with respect to the direction of arrow X, or the direction of travel of the reset button 132. The surface 139*a* of the reset actuator-engagement element 139 can have a generally wedge shape or be part of a wedge, like a triangular wedge as shown in FIGS. 3A-3C. The surface 139*a* of the reset actuator-engagement element 139 can slidably interact with the reset engagement surface 174 of the actuator 172 to move the actuator 172 from the tripped position (FIGS. 2B and 3A) to the closed position (FIGS. 2A and 3C), thereby resetting the control circuit. That is, in response to actuating the reset button 132 in the direction of arrow X, the surface 139*a* is forced in the direction of arrow X into the reset engagement surface 174, which causes the actuator 172 to rotate about pivot point A (FIGS. 2A and 2B) in the direction of arrow Y (FIGS. 3A-3C).

In response to the reset button 132 being actuated in the direction of arrow X from the normal position (FIG. 3A) to the reset position (FIG. 3C): (1) the spring 140 transitions from the first position (FIG. 3A), through the intermediary position (FIG. 3B), to the second position (FIG. 3C); (2) the surface 139*a* of the reset actuator engagement element 139 initially contacts or mates with the reset engagement surface 174 of the actuator 172 as shown in FIG. 3A; (3) the surface 139*a* slides along the reset engagement surface 174 to the intermediary position as shown in FIG. 3B; and (4) the reset engagement surface 174 releases from the surface 139*a* as the actuator rotates about pivot point A into the closed position as shown in FIG. 3C. After the resetting of the overload relay trip mechanism 100, (1) to (4), as described above, in response to the actuation of the reset button 132 in the direction of arrow X being removed (not being actuated), the spring 140 can automatically adopt the first position (FIG. 3A), thereby automatically returning the reset button 132 to the normal position (FIG. 3A), while the overload relay trip mechanism 100 remains in the closed position (FIG. 2A).

The shaft portion 136 of the reset button 132 has a first width $W_1$ and a second width $W_2$, as illustrated in FIG. 3C. A majority portion of the shaft portion 136 and/or a central portion of the shaft portion 136 has the first width $W_1$. A second minority portion of the shaft portion 136 near the second end 138 has the second width $W_2$. Generally, a portion of the reset actuator-engagement element 139 has the second width $W_2$. The first width $W_1$ is narrower than the second width $W_2$ of the shaft portion 136 such that the actuator 172 can be moved from the closed position (FIG. 2A) to the tripped position (FIG. 2B) even if the reset button 132 is in the reset position (FIG. 3C). That is, the overload relay trip mechanism 100 can be tripped electronically even if the reset button 132 is held or jammed in the reset position (FIG. 3C). As shown in FIG. 3C, the narrow width $W_1$ of the central portion of the shaft portion 136 provides clearance for the actuator 172, or more specifically, the reset engagement surface 174, to move into the open position (FIG. 2B). Such a feature is known in the art to which the present disclosure pertains as a "trip-free" feature. As shown in FIGS. 3A-3C, the overload relay trip mechanism 100 provides such a trip-free feature using only two components—the reset button 132 and the spring 140.

A two-component reset button assembly, as described herein and shown in the Figures, is advantageous because it requires fewer components than a comparable prior art reset button assembly that can (1) reset a tripped overload relay trip mechanism and (2) provide a trip-free feature.

While the spring 140 was described above as a negative-rate spring, the spring 140 can alternatively be a bistable spring where the first and the second positions of the spring 140 are a first stable position and a second stable position of the spring 140, respectively. That is, the spring 140 can alternatively be a bistable spring that biases the reset button 132 in the normal position (FIG. 3A) or in the reset position (FIG. 3C). In response to a force in the direction of arrow X being removed from the reset button 132, the bistable spring can remain in the second stable position. That is, the bistable spring can require a force in a direction opposite that of arrow X to return to the first stable position. Such an opposite force can be applied to a second end of the bistable spring by an operator pulling the reset button 132 in the opposite direction or by a return spring acting on the reset button 132 in the opposite direction, thereby causing the bistable spring to readopt or revert back to the first stable position.

Figure 4A:
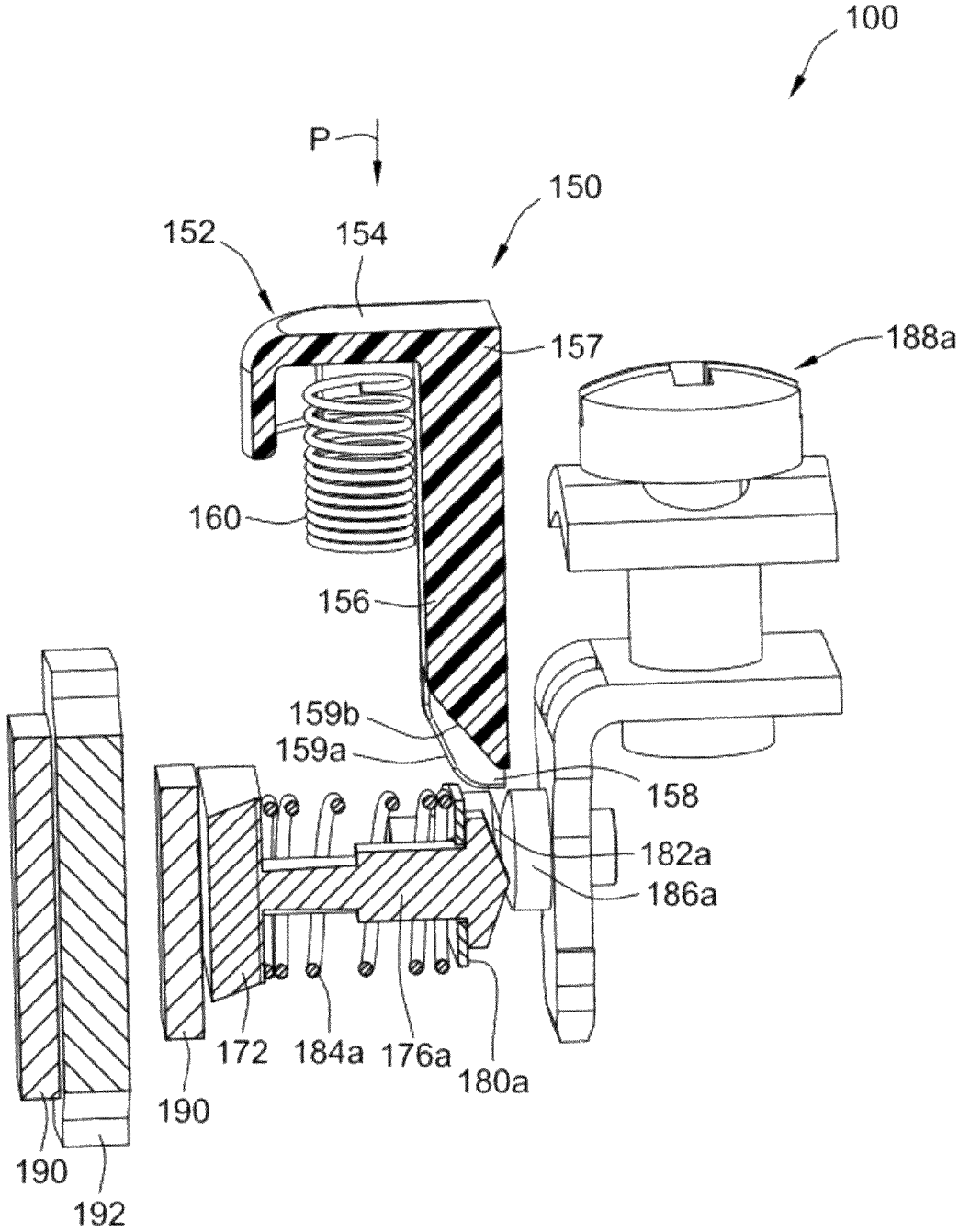
FIG. 4A is a partial cross-sectional back view of the overload relay trip mechanism of FIG. 1 in a closed position with the housing removed and a test button in a normal position according to some aspects of the present disclosure.
Figure 4B:
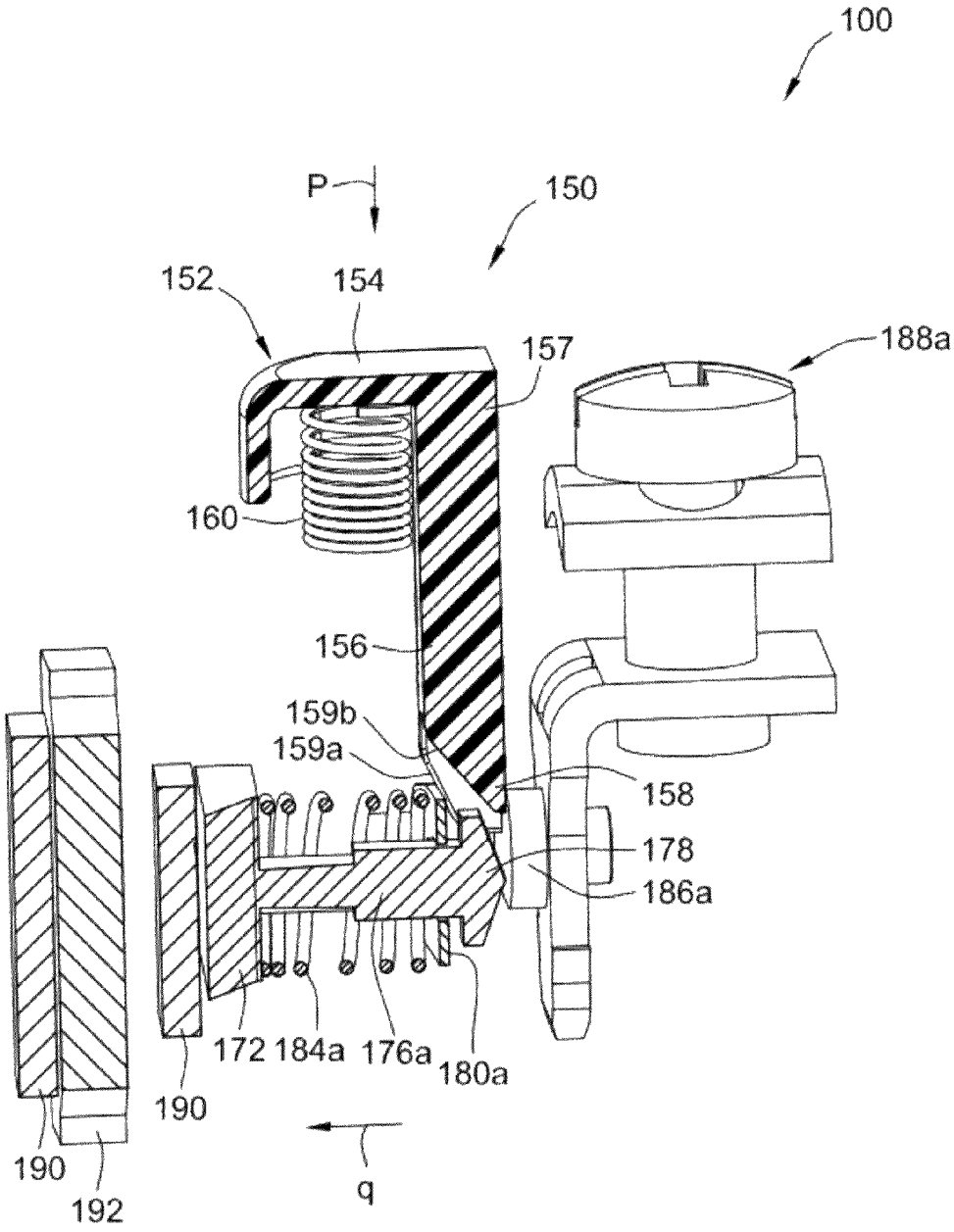
FIG. 4B is a partial cross-sectional back view of the overload relay trip mechanism of FIG. 4A with the test button in a test-stop position according to some aspects of the present disclosure.
Figure 4C:
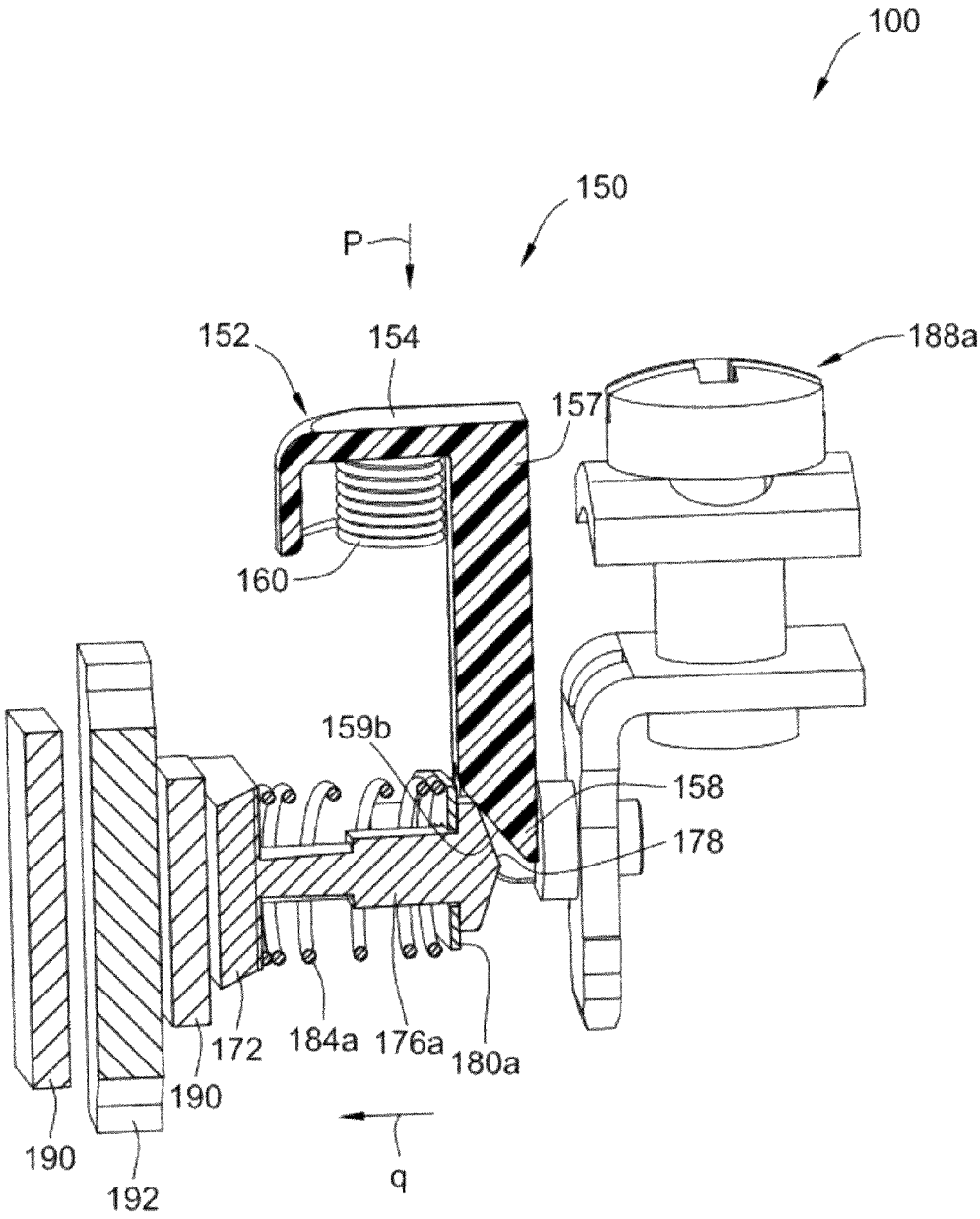
FIG. 4C is a partial cross-sectional back view of the overload relay trip mechanism of FIG. 4A with the test button in a test-trip position according to some aspects of the present disclosure.

Referring generally to FIGS. 4A-4C, a method or mode of testing the overload relay trip mechanism 100 and a method or mode of tripping the overload relay trip mechanism 100 using the test button assembly 150 is disclosed. FIGS. 4A-4C are partial cross-sectional back views of the overload relay trip mechanism 100 with the housing 110 removed to better illustrate the test button assembly 150. FIG. 4A illustrates the test button assembly 150 in a normal position. FIG. 4B illustrates the test button assembly 150 in a test-stop position. FIG. 4C illustrates the test button assembly 150 in a test-trip position.

The test button assembly 150 includes a test button 152 and a spring 160. The test button 152 has a button portion 154 and a shaft portion 156. The shaft portion 156 has a first end 157 and a second opposing end 158. The first end 157 of the shaft portion 156 is physically coupled with the button portion 154. The second opposing end 158 of the shaft portion 156 includes a first actuator-engaging element 159*a* and a second actuator-engaging element 159*b*, also referred to herein as test actuator-engagement elements 159*a,b*. The test button 152 generally has a normal position (FIG. 4A), a test-stop position (FIG. 4B), and a test-trip position (FIG. 4C). The normal position can also be referred to as a resting position of the test button 152. The test button 152 can be actuated in a direction of arrow P by, for example, an operator's finger, from the normal position (FIG. 4A) to the test-stop position (FIG. 4B) and further to the test-trip position (FIG. 4C).

The spring 160 is positioned between the button portion 154 of the test button 152 and the top portion 110*a* of the housing 110 such that movement of the test button 152 in the direction of arrow P, or a direction of travel of the test button 152, compresses the spring 160 between the button portion 154 and the top portion 110*a* of the housing 110. The spring has a first position, shown in FIG. 4A, that corresponds with the normal position of the test button 152, a second position, shown in FIG. 4B, that corresponds with the test-stop position of the test button 152, and a third position, shown in FIG. 4C, that corresponds with the test-trip position of the test button 152.

The spring 160 is generally uncompressed in the first position, although the spring 160 can be compressed in the first position (FIG. 4A). The spring 160 is compressed more in the second position (FIG. 4B) than in the first position (FIG. 4A) and more in the third position (FIG. 4C) than in the second position (FIG. 4B). The spring 160 can be one of a variety of springs, such as, for example, a traditional coil spring, a Belleville spring, a leaf spring, a conical spring, a dual-rate spring, etc.

In response to the spring 160 being a dual-rate spring 160, an actuation force needed in the direction of arrow P to actuate or move the test button 152 from the test-stop position (FIG. 4B) to the test-trip position (FIG. 4C) is greater than the actuation force needed in the direction of arrow P to actuate or move the test button 152 from the normal position (FIG. 4A) to the test-stop position (FIG. 4B). As such, an operator of the overload relay test mechanism 100 can selectively actuate or move the test button 152 into the test-stop position (FIG. 4B) or the test-trip position (FIG. 4C) based on an amount of force applied to the test button 152—a lesser amount being applied to activate the test-stop position (FIG. 4B) than the test-trip position (FIG. 4C).

The dual-rate spring 160 includes a first spring constant and a second spring constant. The first spring constant corresponds with motion from the first position to the second position of the dual-rate spring 160 and the second spring constant corresponds with motion from the second position to the third position of the dual-rate spring 160. A ratio of the first spring constant to the second spring constant is at least 2:1. Such a first-to-second-spring-constant ratio provides a dual-rate spring, such as the dual-rate spring 160, that requires a larger activation force to actuate the test button 152 from the test-stop position (FIG. 4B) to the test-trip position (FIG. 4C) than from the normal position (FIG. 4A) to the test-stop position (FIG. 4B).

The first and the second test actuator-engagement elements 159*a,b* can be physically integral with or otherwise coupled to the second opposing end 158 of the shaft portion 156 of the test button 152. The test button 152 can be a single part that can be formed from, for example, an injection plastic-molding process. The first test actuator-engagement element 159*a* is a surface that can be angled with respect to the direction of arrow P, or the direction of travel of the test button 152. Similarly, the second test actuator-engagement element 159*b* is a surface that can be angled with respect to the direction of arrow P, or the direction of travel of the test button 152. The first and the second test actuator-engagement elements 159*a,b* can generally be part of respective wedges or have wedge shapes, like triangular wedges as shown in FIGS. 4A-4C. The angles of the first and the second test actuator engagement elements 159*a,b* can be the same or different.

The first and the second test actuator-engagement elements 159*a,b* are generally staggered such that the first test actuator-engagement element 159*a* is closer to the second end 158 of the shaft portion 156 than the second test actuator engagement element 159*b*. That is, in response to the test button 152 being actuated in the direction of arrow P, the first test actuator-engagement element 159*a* engages the contact assembly 170 (FIGS. 1, 2A, and 2B) prior to the second test actuator-engagement element 159*b* engaging the contact assembly 170.

The first test actuator-engagement element 159*a* can slidably interact with the moveable contact blade 180*a* of the contact assembly 170 in response to the test button 152 being actuated from the normal position (FIG. 4A) to the test-stop position (FIG. 4B). The first test actuator-engagement element 159*a* moves the moveable contact blade 180*a* and the coupled moveable run contacts 182*a,b* with respect to the actuator 172 in the direction of arrow q (FIGS. 4B and 4C), while the actuator 172 does not move from the closed position (FIG. 4A). The moveable contact blade 180*a* and the coupled moveable run contacts 182*a,b* are moved along the first contact post 176*a* in the direction of arrow q such that the first contact spring 184*a* is compressed. The actuation of the test button 152 from the normal position (FIG. 4A) to the test-stop position (FIG. 4B) causes the first test actuator engagement element 159*a* to move the moveable run contacts 182*a,b* from an electrically connected position (FIG. 4A) to an electrically disconnected position (FIG. 4B). An actuation and release of the test button 152 from the normal position (FIG. 4A) to the test-stop position (FIG. 4B) can perform a test-stop feature or function that momentarily cuts or disconnects the flow of electricity from the moveable run contacts 182*a,b* to the fixed run contacts 186*a,b*.

The second test actuator-engagement element 159*b* can slidably interact with the test engagement surface 178 (FIGS. 4B and 4C) of the first contact post 176*a* of the actuator 172 in response to the test button 152 being actuated from the normal position (FIG. 4A) and/or the test-stop position (FIG. 4B) to the test-trip position (FIG. 4C). The actuation of the test button 152 from the normal position (FIG. 4A) and/or the test-stop position (FIG. 4B) to the test-trip position (FIG. 4C) causes second test actuator-engagement element 159*b* to slidably interact with the test engagement surface 178 of the actuator 172, as shown in FIG. 4C, to rotate the actuator 172 about the fixed pivot point A (FIGS. 2A and 2B) from the closed position (FIGS. 2A and 4A) to the tripped and/or test-trip position (FIGS. 2B and 4C), thereby breaking the control circuit. An actuation and release of the test button 152 from the normal position (FIG. 4A) and/or the test-stop position (FIG. 4B) to the test-trip position (FIG. 4C) can perform a test-trip feature or function that cuts or disconnects the flow of electricity from the moveable run contacts 182*a*,b to the fixed run contacts 186*a,b* by tripping the overload relay trip mechanism 100.

In response to the test button 152 being actuated in the direction of arrow P from the normal position (FIG. 4A) to the test-stop position (FIG. 4B) and then to the test-trip position (FIG. 4C): (1) the spring 160 is compressed from the first position (FIG. 4A) to the second position (FIG. 4B); (2) the first test actuator-engaging element 159*a* contacts or mates with the moveable contact blade 180*a* of the contact assembly 170 as shown in FIG. 4B; (3) the moveable contact blade 180*a* and coupled moveable run contacts 182*a,b* are moved from an electrically connected position (FIG. 4A) to an electrically disconnected position (FIG. 4B); (4) the spring 160 is compressed from the second position (FIG. 4B) to the third position (FIG. 4C); (5) the second test actuator-engaging element 159*b* contacts or mates with the test engagement surface 178 of the actuator 172 as shown in FIG. 4C; and (6) the actuator 172 rotates about pivot point A into the tripped position (FIG. 2B).

A two-component test button assembly, as described herein and shown in the Figures, is advantageous because it requires less components than a comparable prior art test button assembly that can provide a test-stop feature and a test-trip feature.

While particular aspects, implementations, and applications of the present disclosure have been illustrated and described, it is to be understood that the present disclosure is not limited to the precise construction and compositions disclosed herein and that various modifications, changes, and variations may be apparent from the foregoing descriptions without departing from the spirit and scope of the invention as defined in the appended claims.

What is claimed is:

1. An overload relay trip mechanism for selectively opening and closing a control circuit, comprising:

a housing having an aperture;

a reset button, wherein a part of the reset button is positioned through the aperture, the reset button including a button portion and a shaft portion, the shaft portion having a first end coupled with the button portion and a second opposing end having an actuator-engaging element, the reset button having a normal position and a reset position;

a spring having a first end and a second opposing end, the first end of the spring being supported by the housing, the second end of the spring being coupled with the shaft portion or the button portion of the reset button, the spring having a first position that corresponds with the normal position of the reset button and a second position that corresponds with the reset position of the reset button; and an actuator coupled with a moveable contact, the actuator having a closed position in which the moveable contact is electrically connectable with a corresponding fixed contact and an open position in which the moveable contact is electrically disconnected from the corresponding fixed contact, wherein the reset button can be moved from the normal position to the reset position to cause the spring to transition from the first position to the second position, which causes the actuator-engaging element to move the actuator from the open position to the closed position, thereby resetting the control circuit.

2. The overload relay trip mechanism of claim 1, wherein the spring is a negative-rate spring that deforms in response to transitioning from the first position to the second position.

3. The overload relay trip mechanism of claim 1, wherein the spring is a bistable spring that deforms in response to transitioning from the first position to the second position.

4. The overload relay trip mechanism of claim 1, wherein the spring includes a first slot and a second slot, the first slot extending from the first end towards the second end and the second slot extending from the second end towards the first end such that the spring is of a generally "H" shape.

5. The overload relay trip mechanism of claim 1, wherein the spring is a negative-rate spring and the housing being configured to squeeze the first end of the negative-rate spring to cause the negative-rate spring to adopt the first position.

6. The overload relay trip mechanism of claim 1, wherein the spring is a bistable spring and the transition of the bistable spring from the first position to the second position causes the bistable spring to snap from the first position to the second position.

7. The overload relay trip mechanism of claim 1, wherein the spring includes a first pair of legs and a second opposing pair of legs, the housing being configured to squeeze the first pair of legs together to cause the spring to adopt the first position, the shaft portion of the reset button being coupled between the second pair of legs.

8. The overload relay trip mechanism of claim 1, wherein the spring is a negative-rate leaf spring or a bistable leaf spring.

9. The overload relay trip mechanism of claim 8, wherein the spring is concave in the first position and convex in the second position.

10. The overload relay trip mechanism of claim 1, wherein the actuator-engaging element includes an angled surface with respect to a direction of travel of the shaft portion of the reset button, and wherein the angled surface can slidably engage a corresponding reset surface on the actuator to cause the actuator to rotate about a fixed pivot point from the open position to the closed position.

11. The overload relay trip mechanism of claim 10, wherein the angled surface of the actuator-engaging element is part of a wedge that extends outwardly from the second end of the shaft portion of the reset button.

12. The overload relay trip mechanism of claim 1, wherein resetting the control circuit closes the control circuit such that electrical current can flow through the moveable contact to the corresponding fixed contact.

13. The overload relay trip mechanism of claim 1, wherein a central portion of the shaft portion of the reset button is narrower than the second end of the shaft portion such that the actuator can be moved from the closed position to the open position in response to the reset button being in the reset position.

14. An overload relay trip mechanism for selectively opening and closing a control circuit, comprising:

a housing having an aperture;

a test button, a part thereof being positioned through the aperture, the test button including a button portion and a shaft portion, the shaft portion having a first end coupled with the button portion and a second opposing end having a first actuator-engaging element and a second actuator-engaging element, the test button having a normal position, a test-stop position, and a test-trip position;

a spring positioned between the button portion of the test button and the housing such that movement of the test button in a direction of travel compresses the spring between the button portion and the housing, the spring having a first position that corresponds with the normal position of the test button, a second position that corresponds with the test-stop position of the test button, and a third position that corresponds with the test-trip position of the test button; and an actuator coupled with a moveable contact, the actuator having a closed position in which the moveable contact is electrically connectable with a corresponding fixed contact and a tripped position in which the moveable contact is electrically disconnected from the corresponding fixed contact, wherein the test button can be moved from the normal position to the test-stop position to cause the first actuator-engaging element to move the moveable contact from an electrically connected position to an electrically disconnected position in the closed position of the actuator, and wherein the test button can further be moved from the test-stop position to the test-trip position to cause the second actuator-engaging element to move the actuator from the closed position to the tripped position.

15. The overload relay trip mechanism of claim 14, wherein the spring is compressed more in the third position than in the second position.

16. The overload relay trip mechanism of claim 14, wherein the spring is a dual-rate spring that includes a first spring constant and a second spring constant, the first spring constant corresponding with motion from the first position to the second position and the second spring constant corresponding with motion from the second position to the third position.

17. The overload relay trip mechanism of claim 16, wherein a ratio of the first spring constant to the second spring constant is at least 2:1.

18. The overload relay trip mechanism of claim 16, wherein the actuation of the test button from the normal position to the test-stop position requires a first amount of force to be exerted on the test button in the direction of travel, and wherein the actuation of the test button from the test-stop position to the test-trip position requires a second amount of force to be exerted on the test button in the direction of travel.

19. The overload relay trip mechanism of claim 18, wherein the second amount of force is greater than the first amount of force.

20. The overload relay trip mechanism of claim 14, wherein both the first and the second actuator-engaging elements include a respective angled surface that is angled with respect to the direction of travel of the shaft portion of the test button, and wherein the first actuator-engaging-element angled surface can slidably engage a moveable contact blade slidably coupled with the actuator to cause the moveable contact to move with respect to the actuator in the closed position from the electrically connected position to the electrically disconnected position and the second actuator-engaging-element angled surface can slidably engage a contact post of the actuator to cause the actuator to rotate about a fixed pivot point from the closed position to the tripped position.

21. The overload relay trip mechanism of claim 20, wherein the first and the second actuator-engaging-element angled surfaces are part of respective wedges.

22. An overload relay trip mechanism for selectively opening and closing a control circuit, comprising:

a housing having a first aperture and a second aperture;

a reset button having a reset actuator-engaging element, wherein a part of the reset button is positioned through the first aperture, the reset button having a normal position and a reset position;

a negative-rate spring being supported by the housing and coupled with the reset button, the negative-rate spring having a first position that corresponds with the normal position of the reset button and a second position that corresponds with the reset position of the reset button;

a test button having a first test actuator-engaging element and a second test actuator-engaging element, wherein a part of the test button is positioned through the second aperture, the test button having a normal position, a test-stop position, and a test-trip position;

a dual-rate spring positioned between the housing and a portion of the test button, the dual-rate spring having a first position that corresponds with the normal position of the test button, a second position that corresponds with the test-stop position of the test button, and a third position that corresponds with the test-trip position of the test button; and an actuator coupled with a moveable contact, the actuator having a closed position in which the moveable contact is electrically connectable with a corresponding fixed contact and a tripped position in which the moveable contact is electrically disconnected from the corresponding fixed contact, wherein the reset button can be moved from the normal position of the reset button to the reset position to cause the negative-rate spring to transition from the first position to the second position, which causes the reset actuator-engaging element to move the actuator from the tripped position to the closed position, and wherein the test button can be moved from the normal position of the test button to the test-stop position to cause the second actuator-engaging element to move the moveable contact from an electrically connected position to an electrically disconnected position in the closed position of the actuator, and wherein the test button can further be moved from the test-stop position to the test-trip position to cause the third actuator-engaging element to move the actuator from the closed position to the tripped position.

23. The overload relay trip mechanism of claim 22, wherein the reset button includes a button portion and a shaft portion, the shaft portion having a first end coupled with the button portion and a second opposing end including the reset actuator-engaging element.

24. The overload relay trip mechanism of claim 22, wherein the test button includes a button portion and a shaft portion, the shaft portion having a first end coupled with the button portion and a second opposing end including the first test actuator-engaging element and the second test actuator-engaging element, the dual-rate spring being positioned between the button portion of the test button and the housing such that movement of the test button in a direction of travel compresses the dual-rate spring between the button portion and the housing.

* * * * *